US005146482A

United States Patent [19]

Hoover

[11] Patent Number: 5,146,482

[45] Date of Patent: * Sep. 8, 1992

[54] MULTISPECTRAL VARIABLE MAGNIFICATION GLANCING INCIDENCE X-RAY TELESCOPE

[75] Inventor: Richard B. Hoover, Huntsville, Ala.

[73] Assignee: The United States of America as represented by the Administrator of the National Aeronautics and Space Administration, Washington, D.C.

[ * ] Notice: The portion of the term of this patent subsequent to May 21, 2008 has been disclaimed.

[21] Appl. No.: 545,008

[22] Filed: Jun. 28, 1990

Related U.S. Application Data

[63] Continuation-in-part of Ser. No. 765,979, Aug. 15, 1989, Pat. No. 4,941,163.

[51] Int. Cl.[5] ..... G21K 7/00

[52] U.S. Cl. ..... 378/43; 378/210

[58] Field of Search ..... 378/43

[56] References Cited

U.S. PATENT DOCUMENTS 4,562,583 12/1985 Hoover et al. ..... 378/43

5,016,265 5/1991 Hoover ..... 378/43

OTHER PUBLICATIONS

"Layered Synthetic Microstructures Properties and Applications in X-Ray astronomy", Underwood, SPIE, vol. 184, 1979, pp. 123-130.

*Primary Examiner*—Craig E. Church

*Attorney, Agent, or Firm*—Robert L. Broad, Jr.; Guy M. Miller; John R. Manning

[57] ABSTRACT

A multispectral variable magnification glancing incidence x-ray telescope capable of broadband, high resolution imaging of solar and stellar x-ray and extreme ultraviolet radiation sources includes a primary optical system which focuses the incoming radiation to a primary focus. Two or more rotatable mirror carriers each providing a different magnification are positioned behind the primary focus at an inclination to the optical axis, each carrier carrying a series of ellipsoidal mirrors each having a concave surface coated with a multilayer (layered synthetic microstructure) coating to reflect a different desired wavelength. The mirrors of both carriers are segments of ellipsoids having a common first focus coincident with the primary focus. A detector such as an x-ray sensitive photographic film is positioned at the second respective focus of each mirror so that each mirror may reflect the image at the first focus to the detector at the second focus. The carriers are selectively rotated to position a selected mirror for receiving radiation from the primary optical system, and at least the first carrier may be withdrawn from the path of the radiation to permit a selected mirror on the second carrier to receive the radiation.

16 Claims, 5 Drawing Sheets

MULTISPECTRAL VARIABLE MAGNIFICATION GLANCING INCIDENCE X-RAY TELESCOPE

ORIGIN OF THE INVENTION

The invention described herein was made by an employee of the United States Government and may be manufactured and used by or for the Government for Governmental purposes without the payment of any royalties thereon or therefor.

REFERENCE TO RELATED APPARATUS

This application is a continuation-in-part of copending application Ser. No. 765,979 filed Aug. 15, 1985, (now U.S. Pat. No. 4,941,163).

BACKGROUND OF THE INVENTION

This invention relates to x-ray telescopes and more particularly to variable magnification glancing incidence x-ray telescopes capable of multispectral high resolution imaging of solar and stellar x-ray sources having improved spatial resolution.

For applications of obtaining high spatial resolution observations with high sensitivity detectors, such as CCD's or Multi-Anode MicroChannel Arrays (MAMA'S), variable magnifications are highly desirable. However, this capability does not at present exist. Very high resolution telescopes, such as the optical system currently under development for the advanced X-Ray Astrophysics Facility (AXAF) have a fixed focal length and fixed field of view as dictated by the fundamental parameters of the primary mirror. These telescopes have been designed with the greatest emphasis placed upon the harder rather than the softer components of the x-ray spectrum.

The ability to produce images of sources at x-ray energies up to 10 keV is of profound significance to the solution of many of the most important problems of astrophysics and solar physics. An instrument for producing high spatial resolution images of the sun and of astrophysical sources at numerous well defined spectral wavebands is disclosed in applicant's copending application (Ser. No. 756,979) filed on Aug. 15, 1985, entitled Multispectral Glancing Incidence X-Ray Telescope. In that application a telescope system was disclosed which made high resolution and magnification imaging of solar and stellar x-ray and extreme ultraviolet radiation possible. The telescope system there disclosed images over a broad band of x-ray and extreme ultraviolet radiation, in the range of 30 angstroms and below using Wolter type optics without increasing the physical size of the telescope. This was accomplished by combining ellipsoidal layered synthetic microstructure (LSM) mirrors operating at inclined orientations in combination with a glancing incidence Wolter I system with off-axis x-ray detector means with the LSM optics positioned behind the primary focus of the Wolter I primary mirror system, the LSM mirrors being concave in shape. The apparatus therein disclosed thus made it possible to obtain high spatial and spectral resolution images of point sources or of extended sources of x-ray emission at shorter wavelengths (i.e., higher energies), than could be imaged with the spectral slicing x-ray telescope disclosed in applicant's earlier U.S. Pat. No. 4,562,583 dated Dec. 31, 1985, which operated at normal incidence with all optical elements positioned on the optical axis.

Layered synthetic microstructure (LSM) coatings have during the past few years come to be more commonly called "multilayer coatings" or simply "multilayers", and hence the more modern terminology will be used in the present application.

In the prior art, Wolter x-ray telescopes have been used with single or nested mirrors to focus x-rays from astronomically distant point or extended sources. These telescopes use x-ray mirrors which operate at a glancing or grazing angle of incidence. The mirrors may be used uncoated or may be coated with a high-Z material such as gold, platinum or iridium. The solar x-ray telescopes which were flow on SKYLAB operated at grazing angles of 54 arc minutes and could effectively reflect only x-rays of energies lower than the 0.5 keV (wavelengths >6 angstroms). These Wolter Type I mirrors use internally reflecting, coaxial and confocal paraboloidal and hyperboloidal mirrors. Astrophysical telescopes, such as HEAO, XMM and AXAF, have been designed to operate at glancing angles in the range of 20 to 50 arc minutes, making it possible for them to focus and image x-rays with energies up to 8 to 10 keV (wavelengths > 1.2 angstroms). Images with these systems are typically recorded on high resolution photographic film or other solid-state or gas filled detectors such as CCD's Position Sensitive Proportional Counters, Multi-Anode Micro-Channel Arrays (MAMAS). Techniques for coupling Wolter telescopes to solid state detectors by means of convex hyperboloid mirrors were described in the aforesaid U.S. Pat. No. 4,562,583. However, this device is not capable of operating over the entire wavelength range which can be covered by glancing incidence x-ray telescopes due to the difficulty of fabricating Layered Synthetic Microstructure (LSM) coatings capable of operating at wavelengths significantly less than 30 angstroms when configured at normal incidence.

The primary disadvantages of using the telescope directly with a solid state detector is that the full resolution capabilities of the primary x-ray mirror can not be utilized due to limitations that exist in the ability to fabricate solid state detectors with pixel sizes significantly smaller than 10 microns In the applicant's copending application Ser. No. 756,979 entitled Multispectral Glancing Incidence X-Ray Telescope, a system was disclosed having the capability of obtaining high resolution images in different spectral bands over the entire wavelength range that the glancing incidence primary optic was capable of reflecting (2Å–100 Å). Disclosed in that application was a high resolution x-ray telescope having a rotatable cylindrical carrier on which a plurality of concave mirrors were mounted, the mirrors being coated with different coatings, and the carrier being rotated to place a selected mirror in the path of the reflected incoming beam to obtain high resolution images of different wavelengths dependent upon which mirror was selected.

SUMMARY OF THE INVENTION

Accordingly, it is a primary object of the present invention to provide a high resolution x-ray telescope capable of yielding multispectral images of solar and stellar sources with variable magnification and field of view at wavelengths selected over the x-ray and extreme ultraviolet range.

It is another object of the present invention to provide a high sensitivity glancing incidence x-ray telescope capable of producing multispectral high spatial resolution images, with variable magnification and variable field of view, of solar and stellar x-ray and extreme ultraviolet radiation sources with good spectral resolution, the spectral bandpass being readily selectable from a plurality of narrow wavebands in the entire wavelength range of coverage of the glancing incidence primary optic (2Å–100Å).

It is a further object of the present invention to provide a high sensitivity variable magnification and field of view glancing incidence x-ray telescope capable of producing multispectral high spatial resolution images of solar and stellar x-ray and extreme ultraviolet radiation sources, the spectral bandpass being readily selectable from a plurality of mirrors on a rotatable carrier, and the magnification and field of view being selectable from a plurality of such carriers, the image being resolved onto one or more x-ray detectors.

Accordingly, the present invention provides an optical system utilizing a plurality of off-axis ellipsoid mirrors operating at angles of incidence inclined relative to the optical axis, preferably less than 60 degrees, polished to a high degree of smoothness and coated with selected multilayer coatings. A plurality of mirrors are carried by each of at least a pair of rotatable carriers which are placed behind the prime focus of a glancing incidence mirror and utilize concave optics. Primary Wolter-type mirrors focus the incoming x-rays to the primary focus of a glancing incidence optics which is coincident with the first focus of the ellipsoidal multilayer mirrors, and at least one high sensitivity, high resolution detector is placed at the other focus of the ellipsoidal multilayer mirrors. Selection of a carrier places a first set of mirrors in the path to receive the incoming beam to provide a first magnification and field of view, and selection of a mirror of the first set provides a selected wavelength. Rotating the carrier changes the selected mirror and thus the selected wavelength. Changing the selected carrier changes the magnification and field of view.

In the preferred embodiment x-rays of the selected wavelength are reflected to a detector at the second focus of the ellipsoidal mirrors. Preferably, the different mirrors on each rotating carrier have the same surface contour but are coated with multilayer coatings of different multilayer composition or 2D parameter. Selection of the carrier is provided by retracting at least the first carrier from the beam to allow the x-ray beam to continue to diverge until it strikes the selected concave ellipsoidal mirror on a second rotatable carrier which also focuses the radiation to the same detector, but an image at a different magnification and field of view is produced from that produced by the first carrier. Fine control over the magnification and field of view may be achieved by the use of a large number of carriers, each with its own array of wavelength selecting multilayer coated concave ellipsoidal mirrors. In an alternate embodiment, a plurality of multilayer mirrors operating at different wavelengths and capable of providing different magnifications and fields of view are selectable to produce images onto a plurality of x-ray detectors. This permits different x-ray detectors with different performance characteristics to be matched to the optical properties of the imaging system as the magnification and field of view are varied.

The significance of the magnification feature be appreciated by considering that when the telescope is used at low magnification to image extended astrophysical sources, e.g., Supernova Remnants, clusters of galaxies, etc. or to produce full disk images of the Solar Corona, a low magnification and wide field of view (1 degree or more) are required. When detectors with fixed pixel sizes such as CCD's or MAMA's, are used, the spatial resolution will suffer at these low magnifications. Thus after an interesting region of the supernova remnant or the sun has been observed in the low resolution wide field mode, introduction of a different ellipsoidal mirror into the beam will allow the same region to be investigated at much higher magnification and spatial resolution. The very high sensitivity, low magnification mode is very useful for pointing the telescope precisely at faint galaxies or stars, wherein they could then be studied in detail by the lower sensitivity and yet higher magnification and enhanced spatial resolution component of the instrument.

The coating constitutes a synthetic Bragg crystal, and is comprised of a large number (50–1000) of alternating layers of high-Z diffractor material separated by low-Z spacer material. X-rays which strike the coating are reflected by Bragg Diffraction in accordance with the Bragg relation: $n(\lambda)=2D\sin(\theta)$, where n is the diffraction order, $\lambda$ is the wavelength of radiation for which the peak reflectivity occurs, D is the multilayer parameter which is the sum of the thickness of one diffractor layer plus one spacer layer in the multilayer stack, and $\theta$ is the angle at which the incident x-ray strikes the mirror surface. It may be pointed out that glancing angles such as are usually required for Wolter systems are not required for multilayer mirrors designed to cover the wavelengths of x-radia which can be reflected by conventional x-ray telescopes, however, such small angles might be chosen for some particular applications.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

This invention relates to a high resolution, multispectral glancing incidence x-ray telescope of variable magnification. The telescope is capable of producing high spatial resolution images in selected narrow wavebands.

The field of view of the telescope and the magnification (and hence resolution) of the resultant image may be varied by selection of the multilayer ellipsoidal mirror, such selection also allowing the precise wavelength band of interest, over the entire spectral range for which the primary glancing incidence mirror is sensitive to be selected, typically 2 to 100 angstroms. The telescope has particular applications to missions in space.

Figure 1:
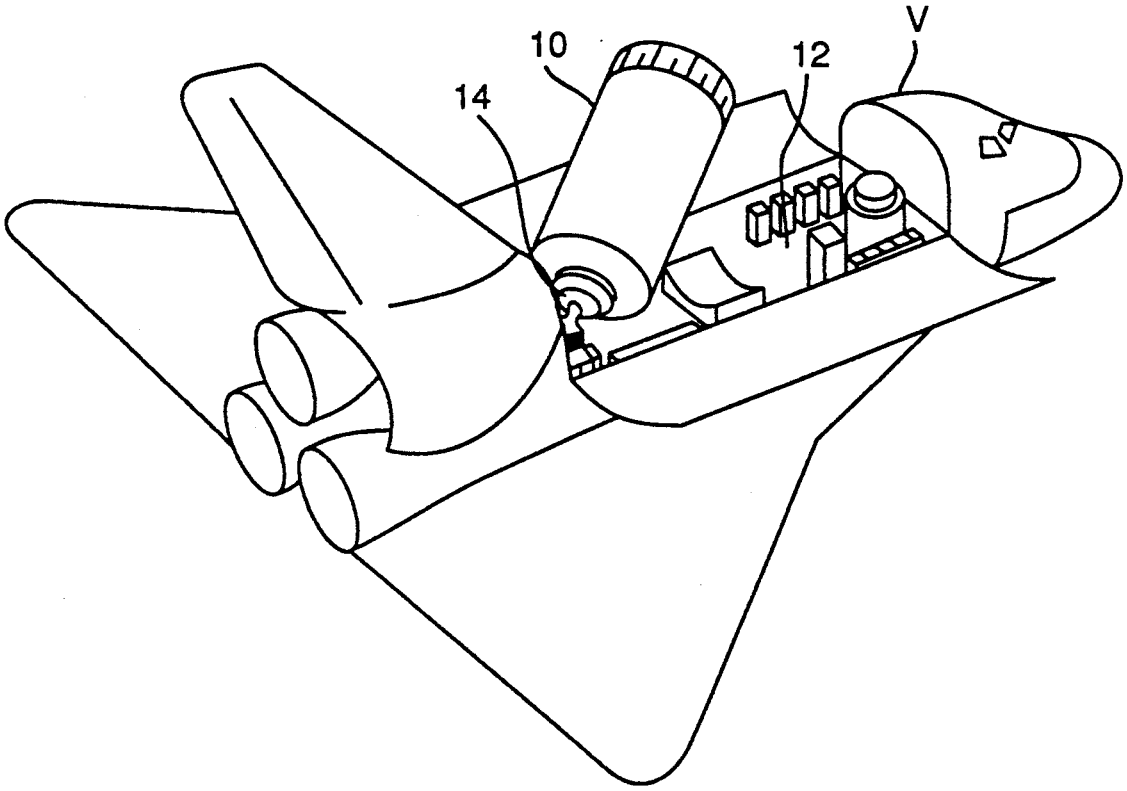
FIG. 1 is a perspective view illustrating an orbiting space shuttle vehicle with the bay open to point an x-ray telescope constructed in accordance with the present invention.

FIG. 1 illustrates the telescope, designated generally at 10, as pointed from the payload bay 12 of an orbiting Space Shuttle Vehicle V, the telescope 10 being mounted on the pointing platform 14, which is used to precisely point the telescope at the sun or at the selected astrophysical source and to maintain it stable and free from vibration for the duration of the exposure. The telescope may be used in an orbiting observatory as utilized in the High Energy Orbiting Observatory launched by the United States National Aeronautics and Space Administration (NASA) or on a major Astrophysical Facility such as AXAF, or aboard the U.S. Space Station FREEDOM, which is currently under development by NASA. As hereinafter described, the variable magnification glancing incidence x-ray telescope 10 uses concave ellipsoidal multilayer mirrors to achieve spectral discrimination, and to permit the image magnification and field of view to be varied.

Figure 2:
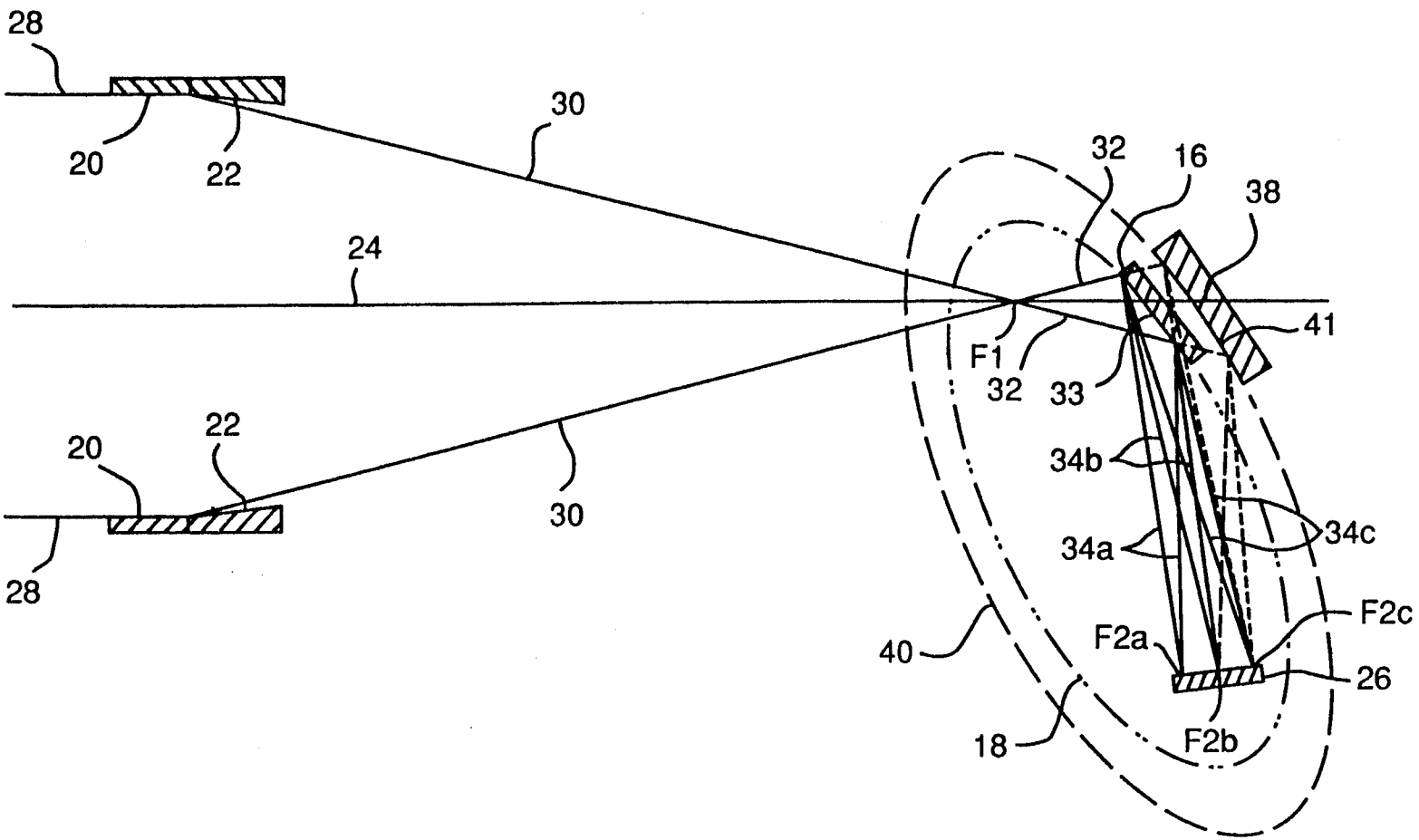
FIG. 2 is a schematic view of the optics of a multispectral variable magnification glancing incidence x-ray telescope constructed in accordance with the present invention, the telescope utilizing a single detector.

Referring now to FIG. 2, the optical system is configured such that the first focus F1 of a concave ellipsoidal mirror 16 forming a segment of an ellipsoid 18 lies at the prime focus of a conventional single Wolter I or Wolter/Schwarzschild glancing incidence x-ray telescope system typically comprising a glancing incidence paraboloidal mirror 20 followed by a glancing incidence coaxial and confocal hyperboloidal mirror 22. Alternatively, the mirrors 20 and 22 may have surface configurations based upon the Wolter II design (internal hyperboloid followed by an externally reflecting hyperboloid), the Narai design (hyperboloid - hyperboloid), or other aspheric-aspheric design configuration of the optical system, without departing from the present invention. The first focus F1 and the center of the ellipsoidal mirror 16 lie on the optical axis 24 of the glancing incidence Wolter telescope optics. The ellipsoid 18 has a second focus F2 and a high resolution x-ray detector 26 is located at the second focus F2 off the optical axis, the detector being a Charge Coupled Device (CCD), a Ranicon, a Multi-Wire Position Sensitive Proportional Camera, a Multi-Annode Microchannel Array, (MAMA) or a camera carrying x-ray sensitive photographic film. X-rays strike the mirrors 20, 22 at less than their critical angle and are effectively reflected to produce an image in the focal plane F1 of the glancing incidence mirror system, the incident beam of x-ray radiation 28 being reflected by the Wolter telescope mirrors 20 and 22 to become a convergent beam 30. After passing through principal focus F1, the x-ray beam diverges as illustrated at 32 until it strikes the concave ellipsoidal mirror 16, located behind the primary focus F1. The mirror 16, which is coated on its concave surface with an X-ray reflecting multilayer coating 33, is inclined relative to the optical axis 24, preferably 60 degrees or less, so that x-rays of shorter wavelengths can be reflected than are possible with normal incidence multilayer optics, the x-rays being reflected as a converging beam 34 toward the second focus F2 of the ellipsoid 18. Thus, the x-rays are reflected to the location of the detector 26 producing a high magnification, relatively low field of view image of the source on detector 26.

Figure 5:
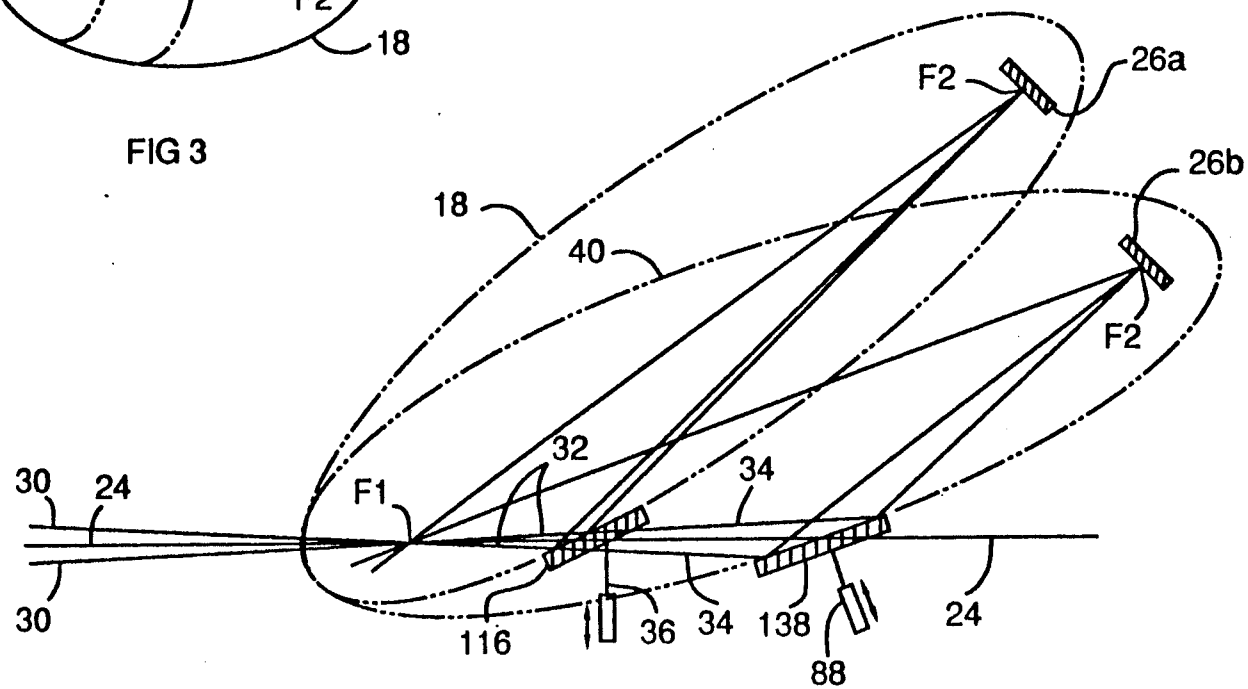
FIG. 5 is a schematic illustration of the focal plane of a multispectral variable magnification glancing incidence x-ray telescope constructed in accordance with a second embodiment of the invention utilizing multiple detectors.
Figure 4:
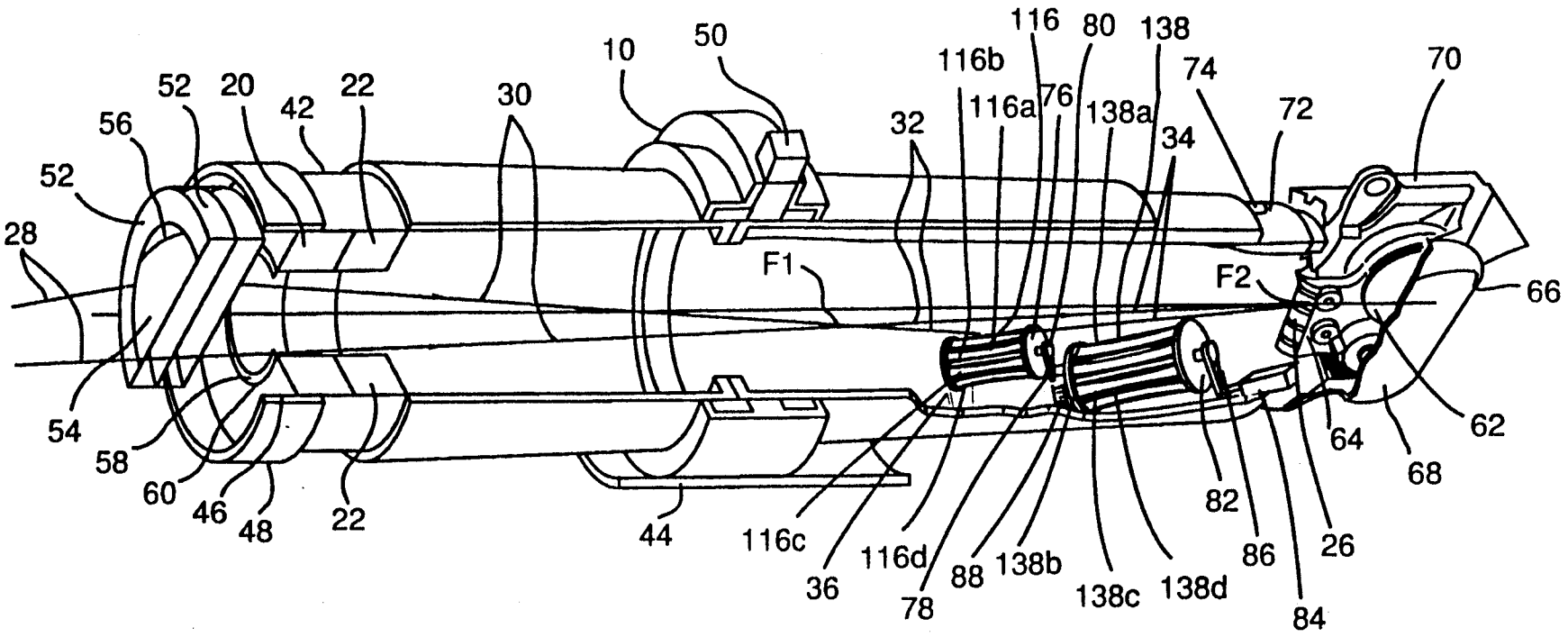
FIG. 4 is a perspective view, partially broken away, of a multispectral variable magnification glancing incidence x-ray telescope constructed in accordance with the present invention.
Figure 6:
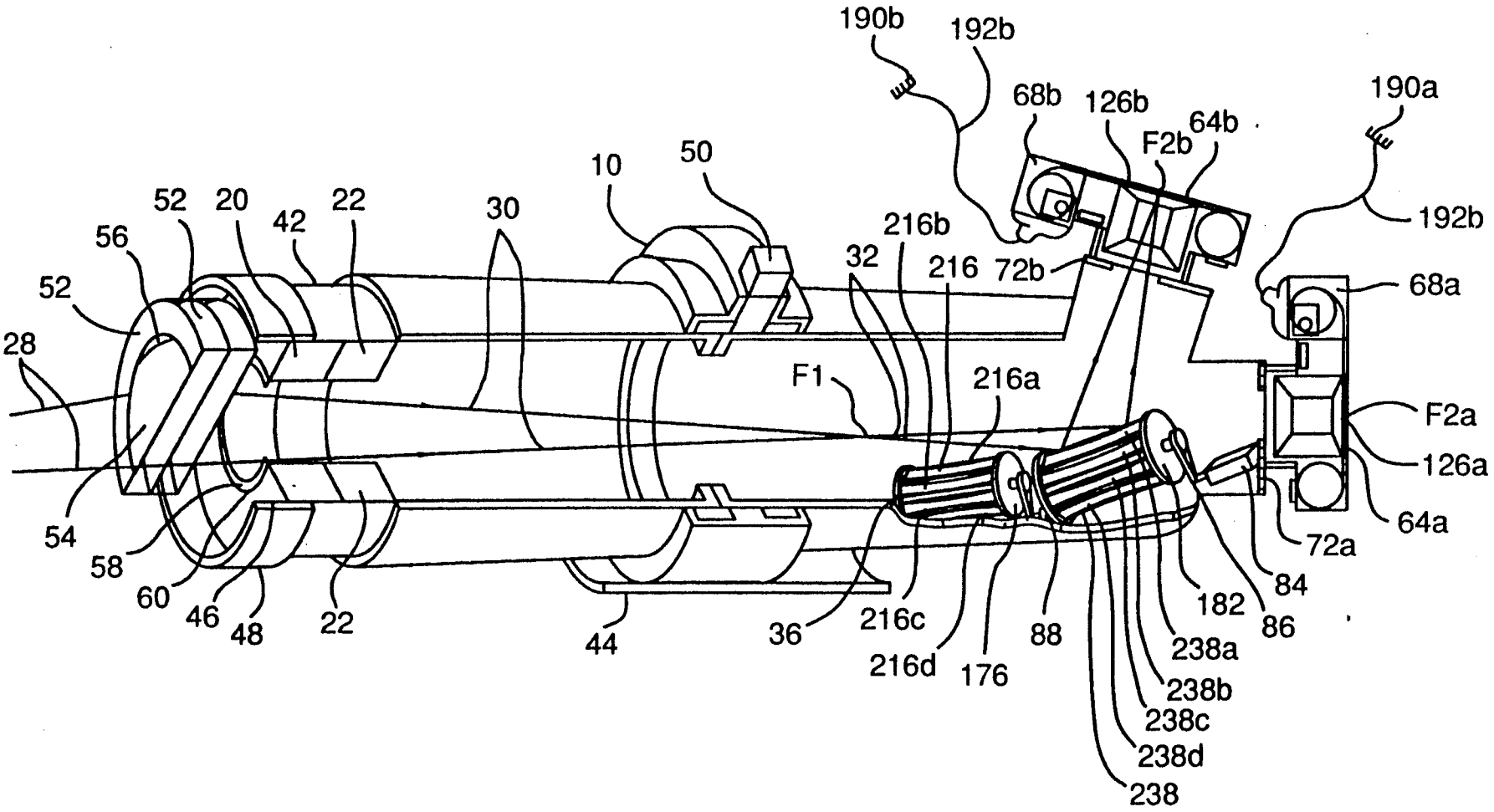
FIG. 6 is a view similar to FIG. 4 of the second embodiment of the present invention.

As hereinafter described the mirror 16 may be withdrawn from the x-ray beam by selection means such as a solenoid activated lever arm 36, which is not illustrated in FIG. 2 for purposes of clarity of presentation but is illustrated in FIGS. 4, 5 and 6, to permit the diverging beam 32 to continue aft until it is intercepted by another concave ellipsoidal mirror 38 forming a segment of an ellipsoid of revolution 40 larger than the ellipsoid 18, but sharing the common foci F1 and F2, the mirror 38 like the mirror 16 also being behind the primary focus F1. This mirror is also coated on its concave surface with an x-ray reflecting multilayer coating 41, and is also inclined relative to the optical axis 24. This will produce a lower magnification and relatively larger field of view image of the source on the detector 26, since the magnification is given by the equation $M=d2/d1$, where d1 is the distance from the first focus F1 to the concave ellipsoidal mirror and d2 is the distance from the concave ellipsoidal mirror to the second focus F2.

Figure 3A:
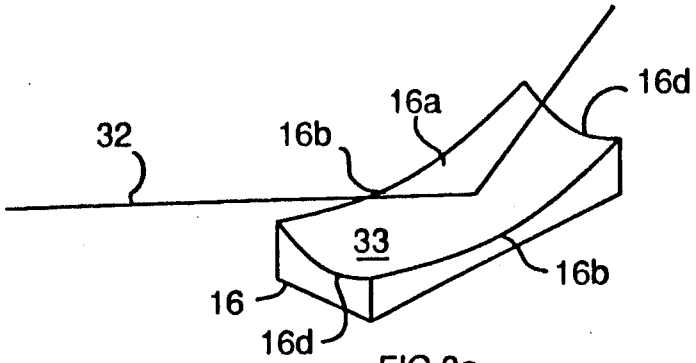
FIGS. 3 and 3*a* are schematic illustrations of concave ellipsoidal multilayer optical elements utilized in the present invention.
Figure 3:
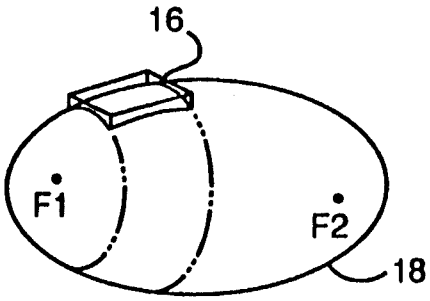

Referring to FIG. 3*a*, the ellipsoidal mirror 16 is provided with a multilayer coating 33 deposited on the concave surface 16*a* of the mirror. FIG. 3 shows the ellipsoid of revolution 18 which determines the surface contour of ellipsoidal mirror 16 employed in the instant invention. The ellipsoidal mirror 16 includes long sides 16*b* and corresponding ends 16*d*. Prior to the application of the multilayer coating 33, the concave surface 16*a* must be polished to a high degree of smoothness, in the order of 3–10 angstroms RMS, for imaging in soft x-ray/XUV range and to a precision of 0.5–3 angstroms RMS for producing high quality images in the x-ray to hard x-ray regime. The multilayers designed to operate with a 2D spacing of 100Å or more surface finishes of 3–10 Å RMS can be used, as can be achieved by conventional float or bowl feed polishing techniques. However, even at these wavelengths, the performance of the final mirror can be improved by starting with the best possible mirror substrate. Consequently, the superior results of ultrasmooth surfaces which can be achieved by the recently developed Ion Polishing and Advanced Flow Polishing methods are to be preferred. These techniques can produce ultra-smooth mirror surfaces (0.5Å–3 RMS). The mirror substrates should be of a stable material capable of receiving such an ultrasmooth surface finish and which can be contoured to the proper figure. Ideal substrates include Zerodur, Cervit, Fused Silica, ULE Fused Silica and some more exotic materials, such as sapphire and glassy carbon. Low expansion coefficient is highly desirable for optics which will receive a significant thermal loading. For solar telescopes, the use of a heat rejecting pre-filter is desirable, and will permit materials such as Hemlite grade sapphire or glassy carbon to be used. These materials can yield the ultimate (0.2–0.7Å RMS) in ultrasmooth surfaces, but they have a somewhat higher thermal coefficient of expansion than materials such as Cervit or Zerodur.

The ellipsoid of revolution shown in FIG. 3*a* has the important optical property that radiation which emanates from one focus F1 of the ellipsoid is re-focused to the second focus F2 of the ellipsoid. For some embodiments, it may also be desirable to use a mirror surface which comprises a segment of a toroid of revolution, and this remains within the spirit and scope of the present invention. Mirror element 16 however, is preferably a concave, inclined ellipsoidal element. As aforesaid, the ellipsoidal element is configured such that one of its foci coincides with the principal focus F1 of the Wolter mirror system and other focus coincides with the high resolution x-ray detector 26. The multilayer coating deposited upon the concave surface 18*a* of the mirror consists of multiple precise alternating layers of a high-Z diffractor material separated by low-Z spacer material layers. D is the thickness of the diffractor plus spacer layer. The 2D parameter and the materials selected for the x-ray multilayer coating 19 are chosen so as to reflect the desired band of x-ray emission. Since these mirrors reflect radiation by Bragg diffraction, the precise wavelength at which the peak reflectivity occurs is determined by the 2D spacing of the multilayer coating and the angle of incidence at which the radiation strikes the mirror. The optical properties of the diffractor and spacer components at the wavelength of interest must be taken into consideration in order to select the optimal composition. Tungsten/Carbon, Rhodium/Carbon, Molydenum/Silicon and other material combinations have been proven to have superb properties of long term stability. Excellent reflectivities (approaching theoretical limits) have been achieved in practice with these materials. Reflectivities at normal incidence in the soft x-ray XUV regime as high as 65% have been documented. At smaller angles of incidence, reflectivities of hard x-rays with reflection efficiencies in excess of 70% have also been measured.

Referring now to FIG. 4, a telescope 10 according to the present invention is illustrated having a mount tube 42 affixed to a mounting plate structure 44 for mounting the telescope to the pointing platform of the vehicle V as illustrated in FIG. 1. The mirrors 20 and 22 are housed within a mirror mount cell 46 which maintains them in alignment and has a mounting flange 48 for mounting the mirrors to the telescope mount tube 42. In the preferred embodiment, the mirror mount cell 46 and the mount tube 42 may comprise filament wound fiber epoxy material, although other material such as Beryllium, Aluminum, or Invar may be suitable if requirements related to outgassing properties, thermoexpansion coefficient or weight should dictate their selection and if economy permits. An optical reference cube 50 may be used for aligning the optical axis of the telescope 10 to other instruments (not illustrated) which may be flown on the same spacecraft to collect simultaneous data at other wavelengths. Heat shield or heat rejection plates 52 mounted at the forward end of the telescope may be used for solar studies to eject unwanted solar heat so as to protect the telescope from excessive heating which could cause de-focus effects. A front aperture stop 54 is utilized to prevent radiation from traveling directly through the center of the Wolter optics and reaching the concave ellipsoidal mirrors without first being reflected by the Wolter optics.

The incident radiation beam 28 enters the telescope through an entrance annulus 56 which is covered with a visible light rejection pre-filter 58, the pre-filter typically being 2000 Å of aluminum on a nickel mesh support structure 60. After the incident radiation beam 28 is reflected by the primary mirror system 20 and 22, the reflected convergent beam 30 converges toward the principal focus F1 and then diverges as a diverging beam 32 behind the principal focus F1 to strike the multilayer coated surface of a selected one of either a first or a second set of inclined ellipsoidal mirrors 116, 138 as hereinafter described, the first focus of each mirror coinciding with principal focus F1 of the primary Wolter I x-ray mirror system. The beam after striking a mirror is reflected as a narrow selected wavelength band, dependent upon the mirror selected, and is brought to focus on the single detector 26 in the embodiment of FIG. 4, the detector 26 being disposed at the second focus F2 of the ellipsoidal mirrors. In the preferred embodiments, the detector 26 is a photographic film carried on a spool 62 and pressed flat in the focal plane F2 by a platen 64. The film is advanced by a motor drive 66 in accordance with electronic signals received by drive electronics (not illustrated). The film and drive assembly may be mounted within a camera housing 68 equipped with a handle 70 to permit an astronaut to remove and replace the film during an EVA. The camera housing 68 is mounted to the telescope housing 42 by means of a flange 72 and an adapter plate 74. Although a film camera is illustrated in the preferred embodiment, other detectors such as CCD's, MAMA's, etc. may be readily utilized in accordance with the present invention.

The first set of mirrors 116 comprises a plurality of inclined concave ellipsoidal multilayer coated mirrors 116*a*, 116*b*, 116*c*, 116*d*, mounted on a cylindrical carrier 76 substantially parallel to the axis of the carrier intermediate the ends thereof, the carrier being oriented at a desired angle and being positioned with respect to the optical axis 24 to present each mirror 116*a*, 116*b*, 116*c*, 116*d*, at a desired inclination to the axis and the radiation beam 32. Each of the mirrors 116*a* through 116*d* is of the same ellipsoidal section of the ellipsoid 18, illustrated in FIG. 2, so that the primary image focused at F1 is always re-imaged onto the image plane of the detector 26 at focus F2. The exact multilayer coating for each mirror element 116*a* through 116*d* is different, so that each mirror will reflect a different x-ray wavelength.

A drive motor in the form of a stepper motor 78 is provided for selectively rotating the carrier 76, the motor driving the carrier by means of a belt 80 trained about pulleys at the ends of the respective motor and carrier. Although a stepper motor is the preferred form of drive mechanism, other drives such as a Geneva mechanism, or other drive means for accurately positioning the cylinder to dispose a selected mirror onto the optical axis may be utilized to select one of a plurality of x-ray wavelengths. While only four mirrors are illustrated, it is to be understood that any number of such mirrors may be employed, each with a different multilayer coating, the greater the number of mirrors utilized, the greater the number of different wavelengths that may be recorded on the detector 26.

The cylindrical drive carrier 76 is mounted on the retractable solenoid activated lever arm 36 so that the carrier may be withdrawn from the beam 32 to allow the beam to continue aft to allow it to expand until it is intercepted by a selected one of the second set of mirrors 138. The second set of mirrors 138 comprises a plurality of inclined concave ellipsoidal multilayer coated mirrors 138*a*, 138*b*, 138*c*, 138*d*, mounted on a second cylindrical carrier 82 in the same manner in which the mirrors 116*a* through 16*d* are mounted on the first carrier 76. The carrier 82 is oriented at a desired angle and positioned with respect to the optical axis 24 to present each mirror 138*a*, 138*b*, 138*c*, 138*d*, at the desired inclination relative to the axis 24 and the incoming radiation beam 32. Preferably, in the embodiment illustrated in FIG. 4, both carriers are inclined at substantially the same angle to reflect the radiation from their respective mirror to the single detector 26. Drive motor means 84 similar to the drive motor 78 is provided for selectively rotating the cylindrical carrier in a similar manner and for the same purpose that the motor 78 drives the first cylindrical carrier 76 by means of a drive belt 86. The second cylindrical carrier 82 may also be carried by a solenoid activated lever arm 88 for permitting the carrier 82 to be withdrawn from the radiation beam or re-inserted into the beam selectively if desired. Each of the mirrors 138*a* through 138*d* is of the same ellipsoidal section of the ellipsoid 40, illustrated in FIG. 2, so that the primary image focused at F1 is always re-imaged onto the image plane of the detector 26 at F2 when one of the mirrors 138*a* through 138*b* is inserted into the beam. As in the case of the first set of mirrors 116, the specific multilayer coating for each respective mirror element 138*a* through 138*d* will reflect a different x-ray wavelength.

Although the carrier 82 contains ellipsoidal mirrors belonging to another family of ellipsoids of revolution than those of carrier 76, the ellipsoids have common or coincident foci F1 and F2. The ellipsoidal mirrors 116*a* through 116*d* on the carrier 76 have a greater magnification than the mirrors 138*a* through 138*d* on the carrier 82 since they are closer to F1 and further from F2. Thus, when the first carrier 76 is disposed in the path of the incoming beam 32, a greater magnification and smaller field of view is reflected to the detector 26, but when a larger field of view at lower magnification is desired, the first cylindrical carrier 76 may be withdrawn from the beam by the solenoid activated lever arm 36 to permit the incoming beam to impinge upon one of the selected mirrors on the carrier 82. When the telescope is subsequently pointed such that an interesting region lies on the optical axis 24, the solenoid activated lever arm 36 can then be engaged to move the first cylindrical carrier 76 into the beam to record the image at a greater magnification and smaller field of view onto the detector 26. Although only two carriers 76 and 82 are illustrated, the present invention contemplates the use of a plurality of such carriers and consequently the second carrier 82 includes the solenoid activated lever arm 88 so that both carriers may be withdrawn from the beam by the respective solenoid activated lever arm and permit a mirror on a subsequent carrier to receive the beam. The second solenoid activated lever arm may also be useful to ensure that when a mirror on the first carrier is selected, the second carrier is withdrawn from any reflected radiation reflected by a mirror on the first carrier, and this is particularly important where space is critical.

The multilayer coatings 33 and 41 can be deposited so as to be perfectly uniform if a broader spectral response is desired. If it is desired that the spectral response be as narrow as possible, multilayer coatings 33 and 41 will be deposited upon the ellipsoidal mirrors while the substrates are inclined at the appropriate angle with respect to the sputtering source, rather than lying flat as is the usual case for coating optics by the magnetron sputtering process. This will result in a multilayer coating which has a diffractor and spacer layer thickness which varies as a function of position on the mirror substrate. This type of wedge multilayer coating is called a "laterally graded multilayer coating", and the layers are thin wedges rather than plain parallel layers. With precisely the correct lateral grading of the mirror 2D parameter (for the particular angle at which the ellipsoidal mirror will be operating) the effect of x-ray chromatic aberration can be removed. This effect is produced because the beam 32 diverges after passing through the principal focus F1 of the Wolter optics. Hence rays reflected from the top of the Wolter mirrors strike the ellipsoidal mirror coating 33 at slightly different angles than the angle at which the rays reflected from the bottom of the Wolter mirror strike the ellipsoidal mirror. Rays from the right and left sides strike at exactly the same angles. Properly coated graded multilayer mirrors can correct the x-ray chromatic aberration effects and ensure that the reflected radiation is confined to a narrow x-ray bandpass.

The magnification M of the ellipsoidal mirror as aforesaid is given by the relation: $M=d2/d1$, so that when the first ellipsoidal mirror which is nearest to the principal focus of the grazing incidence primary optic is used to intercept the beam, the highest magnification and smallest field of view is recorded at detector 26. When a second ellipsoidal mirror, which is farther away from the principal focus F1 is used to intercept the beam, lower magnification and wider field of view images are obtained. If a plurality of ellipsoidal mirror carriers are utilized, they could be introduced to permit widely varying magnification and field of view so as to produce a "zoom" x-ray telescope with much finer adjustments in magnification than can be achieved with only two ellipsoidal mirror carriers as shown herein.

The construction illustrated in FIG. 4 utilizes a single detector 26, but as illustrated in FIG. 5, which depicts the focal plane for an alternate embodiment in which there are two retractable concave ellipsoidal mirror sets 116, 138, and two independent detectors 26*a* and 26*b* are proposed, the mirrors being segments of ellipsoids of revolution 18 and 40 which are inclined at different angles with respect to the optical axis 24 to have common foci F1 but different foci F2.

The ellipsoidal mirrors in the respective mirror sets 116, 138 represent different magnifications because of the relative placements with respect to the two foci F1 and F2. The mirrors in the first set operate at a different angle of incidence than the mirrors in the second set, and if they are constructed of multilayers of the same 2D spacing, different bandpasses of radiation will be reflected to the respective detectors 26*a* and 26*b*. Changing from one mirror set to another changes the magnification as well as the wavelength reflected to the respective detector. By properly coating the mirrors, the same wavelength can be reflected from a mirror in the first mirror set 116 and another mirror in the second mirror set 138 despite the different angles of incidence.

Utilizing mirror sets inclined at different angles, FIG. 6 represents a modification of the embodiment illustrated in FIG. 4. Accordingly, the first cylindrical carrier 176 is inclined at a different angle from the second cylindrical carrier 182 to reflect the diverging beam of x-ray radiation 32 impinging upon their respective mirrors 216*a*, 216*b*, 216*c*, 216*d*, and 238*a*, 238*b*, 238*c*, 238*d* respectively, to different detectors 126*a* and 126*b* respectively, the detectors 126*a* and 126*b* being located at respective foci F2*a* and F2*b*. This permits a plurality of spectral bands to be covered with a plurality of magnifications and imaged upon a respective x-ray detector 126*a* and 126*b*. In all other respects the embodiment illustrated in FIG. 6 is the same as that in FIG. 4, but since each detector preferably is photographic film, a duplication of the camera mounting construction is required for each detector. The detector 126*a* records a high magnification, narrow field of view images reflected by the mirrors 216*a* through 216*d* of the carrier 176, while the detector 126*b* records a low magnification, wide field of view images reflected by the mirrors 238*a* through 238*d* carried by the carrier 182. An electrical wiring harness 190 is illustrated for connecting the second camera 68*b* by means of wiring 192 to the camera electronics controller (not illustrated). Although the two detectors illustrated in FIG. 6 are identical, for some applications it may be preferred that different detectors be utilized. For example, the low magnification detector could be a low resolution CCD or MAMA for real time precision pointing to x-ray areas of interest, and the high resolution narrow field images could then be recorded on high resolution photographic film. Such modifications of the present invention are intended to be included within the scope thereof.

Consequently, it may be seen that by utilizing a plurality of inclined ellipsoidal multilayer mirrors operating at different magnifications and wavelengths, it is possible to produce a multispectral glancing incidence telescope with a variable magnification. The use of concave ellipsoidal elements operating at an inclined angle make it possible to magnify an image selected narrow multispectral segments of the beam over the entire wavelength range of which the glancing incidence primary optics is capable of operating.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A variable magnification x-ray telescope for high-resolution imaging of wavelengths in an x-ray and extreme ultraviolet radiation band comprising: a telescope housing, a primary optical system having a glancing incidence primary mirror carried at a receiving end of said telescope housing for reflecting a beam of incident radiation, said primary optical system having an optical axis and a primary focus lying on said axis disposed within said housing, a plurality of rotatable cylindrical mirror carriers disposed one behind the other within said housing behind said primary focus, a plurality of mirrors each having a respective surface corresponding to a segment of a surface of revolution mounted on each of said carriers and positioned at an inclination to said optical axis, each of said mirrors having a layered synthetic microstructure coating on the respective concave surface to enhance the reflectivity of a desired wavelength in said band, the coatings on the mirrors of a first carrier differing from each other and the coatings on the mirrors of at least a second carrier differing from each other, each of said mirrors having a first focus coincident with the primary focus and a second focus off of said optical axis, an x-ray detector disposed at the second focus of each of said mirrors, means for selectively rotating said carriers to select a mirror thereon for receiving said incident radiation beam, and selection means for selectively moving at least the first carrier into and out of a disposition for receiving reflected radiation from said primary system to permit said radiation to strike a selected mirror on said second carrier when said first carrier is moved out of said disposition to form an image upon the detector at the second focus of said selected mirror, and to permit said radiation to strike a selected mirror on said first carrier when said first carrier is in said disposition to form a higher magnification, smaller field of view image upon the detector at the second focus of the selected mirror on said first carrier.

2. A variable magnification x-ray telescope as recited in claim 1, wherein all of said mirrors have a common second focus.

3. A variable magnification x-ray telescope as recited in claim 1, wherein the mirrors on said first carrier are inclined at a first inclination to said optical axis and the mirrors on said second mirror are inclined at a second and different angle to said optical axis so that incident radiation is reflected to a first x-ray detector by the mirrors on said first carrier and is reflected to a different x-ray detector by the mirrors on said second carrier.

4. A variable magnification x-ray telescope as recited in claim 1, wherein the surface of revolution is an ellipsoid and each of said mirrors is an ellipsoidal mirror.

5. A variable magnification x-ray telescope as recited in claim 4, wherein all of said mirrors have a common second focus.

6. A variable magnification x-ray telescope as recited in claim 4, wherein the mirrors on said first carrier are inclined at a first inclination to said optical axis and the mirrors on said second carrier are inclined at a second and different angle to said optical axis so that incident radiation is reflected to a first x-ray detector by the mirrors on said first carrier and is reflected to a different x-ray detector by the mirrors on said second carrier.

7. A variable magnification x-ray telescope as recited in claim 1, wherein said primary focus is disposed on said optical axis.

8. A variable magnification x-ray telescope as recited in claim 7, wherein all of said mirrors have a common second focus.

9. A variable magnification x-ray telescope as recited in claim 7, wherein the mirrors on said first carrier are inclined at a first inclination to said optical axis and the mirrors on said second carrier are inclined at a second and different angle to said optical axis so that incident radiation is reflected to a first x-ray detector by the mirrors on said first carrier and is reflected to a different x-ray detector by the mirrors on said second carrier.

10. A variable magnification x-ray telescope as recited in claim 7, wherein the surface of revolution is an ellipsoid and each of said mirrors is an ellipsoidal mirror.

11. A variable magnification x-ray telescope as recited in claim 10, wherein the mirrors on said first carrier are inclined at a first inclination to said optical axis and the mirrors on said second carrier are inclined at a second and different angle to said optical axis so that incident radiation is reflected to a first x-ray detector by the mirrors on said first carrier and is reflected to a different x-ray detector by the mirrors on said second carrier.

12. A variable magnification x-ray telescope as recited in claim 10, wherein said primary focus is disposed on said optical axis.

13. A variable magnification x-ray telescope as recited in claim 3, wherein the coatings on the mirrors of said second carrier are identical to coatings on respective mirrors on said first carrier.

14. A variable magnification x-ray telescope as recited in claim 12, wherein the surface of revolution is an ellipsoid and each of said mirrors is an ellipsoidal mirror.

15. A method of imaging x-ray and extreme ultraviolet radiation sources comprising the steps of providing a glancing incidence primary mirror system for reflecting a radiation beam of a radiation source toward a primary focus of said primary mirror system located on an optical axis of said system;

providing a first plurality of concave surface ellipsoidal mirrors on a first rotatable carrier behind said primary focus at an inclination to said optical axis so that a first focus of said ellipsoidal mirrors is coincident with said primary focus and a second focus of said ellipsoidal mirrors lies off of said optical axis;

providing a second plurality of concave surface ellipsoidal mirrors on a second carrier behind said first carrier with the mirrors of said second carrier disposed at inclinations to said optical axis and with a first focus of said ellipsoidal mirrors on said second carrier coincident with said primary focus and a second focus of said ellipsoidal mirrors of said second carrier lying off of said optical axis;

providing a layered synthetic microstructure coating on said concave surface of each ellipsoidal mirror to reflect a desired wavelength in said band;

positioning an x-ray detector at a second focus of each of said ellipsoidal mirrors;

selectively rotating at least one of said carriers to select a mirror thereon for receiving radiation from said primary mirror system; and selectively withdrawing said first carrier away from the path of radiation from said primary mirror system to permit said radiation of impinge upon a selected mirror on said second carrier.

16. The method as recited in claim 15, including, arranging the ellipsoidal mirrors on said first carrier at different inclinations from the ellipsoidal mirrors on said second carrier relative to said optical axis, and positioning a first detector at the second focus of the mirrors carried on said first carrier and a second detector at the second focus of the mirrors carried on said second carrier so that a beam of radiation is imaged upon said first detector with said first carrier disposed in the path of radiation from said primary mirror system and upon said second detector when said first carrier is removed.

* * * * *